United States Patent [19]

Whittington et al.

[11] 4,106,384

[45] Aug. 15, 1978

[54] VARIABLE FILTER CIRCUIT, ESPECIALLY FOR SYNTHESIZING AND SHAPING TONE SIGNALS

[75] Inventors: Billy J. Whittington; John William Robinson; Ralph N. Dietrich, all of Jasper, Ind.

[73] Assignee: Kimball International, Inc., Jasper, Ind.

[21] Appl. No.: 688,565

[22] Filed: May 21, 1976

[51] Int. Cl.[2] ..... G10H 1/04; G10H 5/00

[52] U.S. Cl. ..... 84/1.19; 84/1.25; 84/DIG. 9; 84/DIG. 10; 84/DIG. 19; 328/167; 330/100; 330/103

[58] Field of Search ..... 84/1.11, 1.19, 1.24, 84/1.25, DIG. 9, DIG. 10, DIG. 19; 328/167; 330/98–100, 103, 109; 333/70 R, 70 CR

[56] References Cited

U.S. PATENT DOCUMENTS

| | | | |
|---|---|---|---|
| 3,911,776 | 10/1975 | Beigel | 84/1.11 |
| 3,919,648 | 11/1975 | Uetrecht | 328/167 |
| 3,973,223 | 8/1976 | Uchiyama | 84/1.25 X |

*Primary Examiner*—Stanley J. Witkowski

*Attorney, Agent, or Firm*—Albert L. Jeffers; John F. Hoffman

[57] ABSTRACT

A variable filter circuit, especially for synthesizing and shaping tone signals, in which a variable light source is provided which influences light sensitive resistor elements in the filter circuit. The variable circuit, by the use of selector switches, can provide different musical features, such as muted voices, percussion, brass, woodwind and the like, all of which will enhance, for example, existing organ voicing while it is, furthermore, possible to obtain the effect of playing a solo instrument together with organ voicing.

20 Claims, 7 Drawing Figures

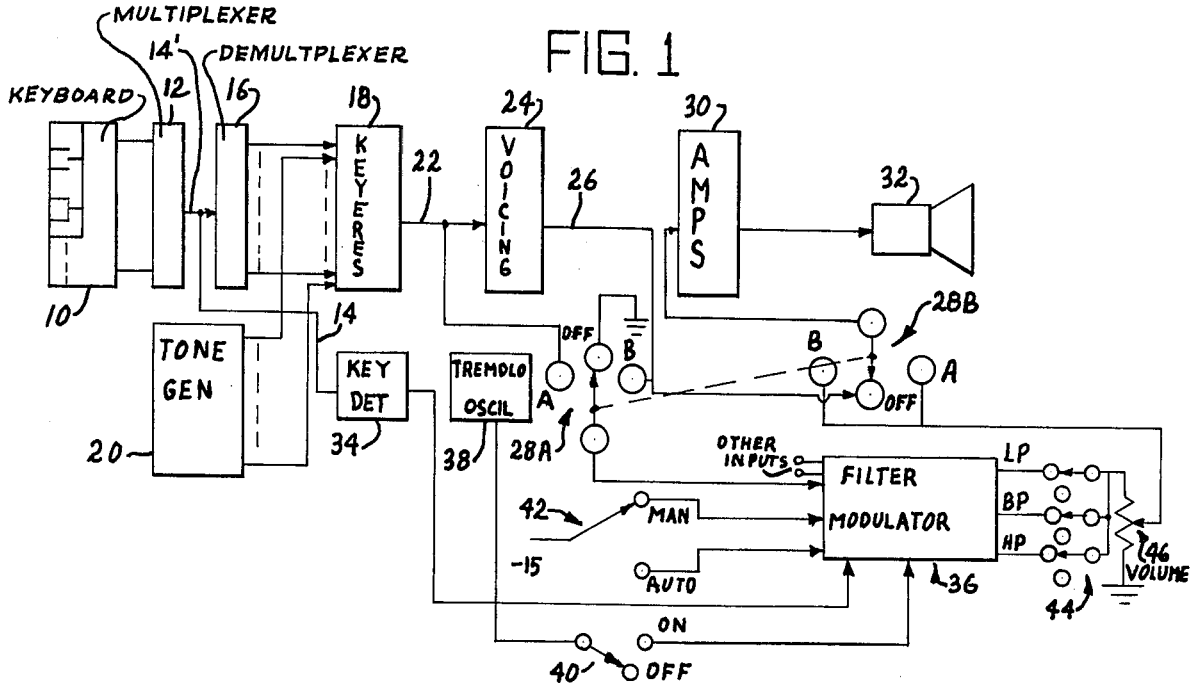
FIG. 1
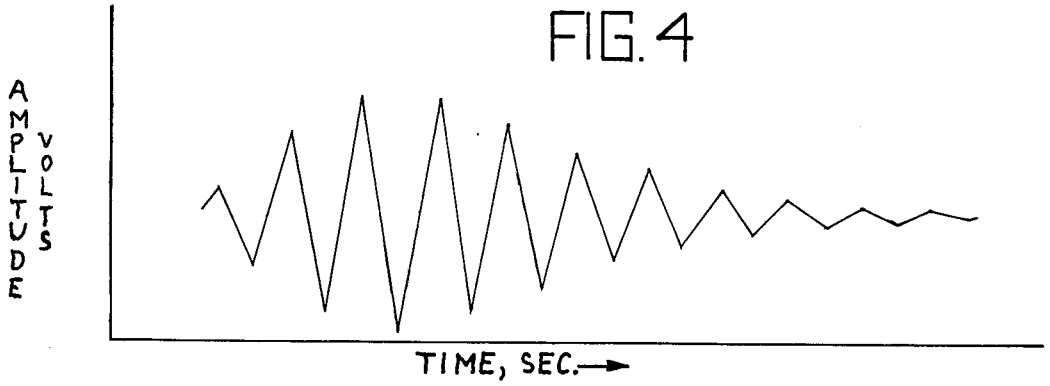
FIG. 4
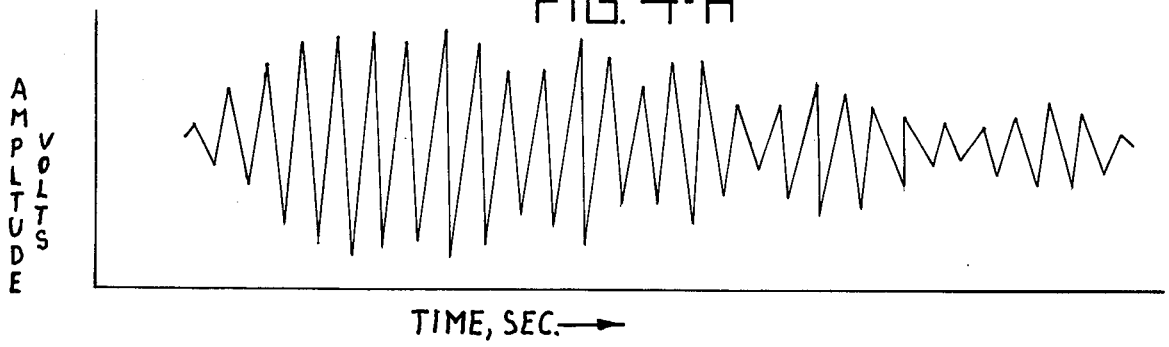
FIG. 4-A

FIG. 3-A
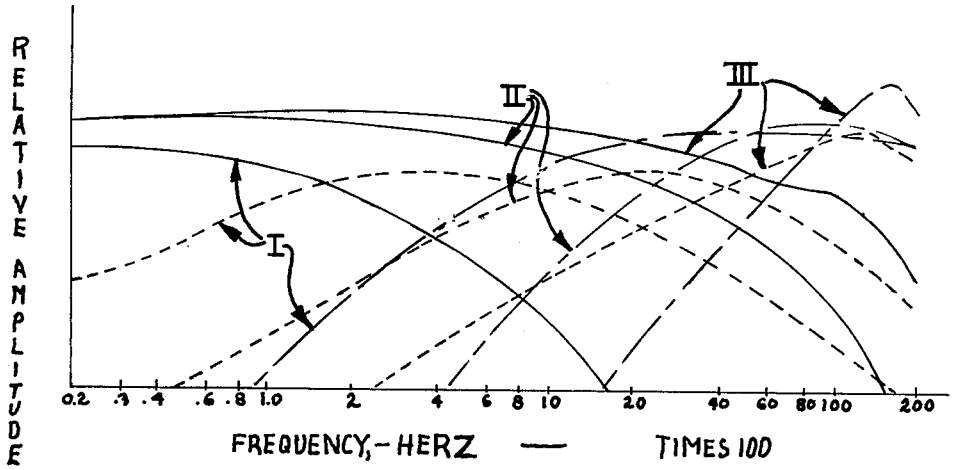
FIG. 3-B
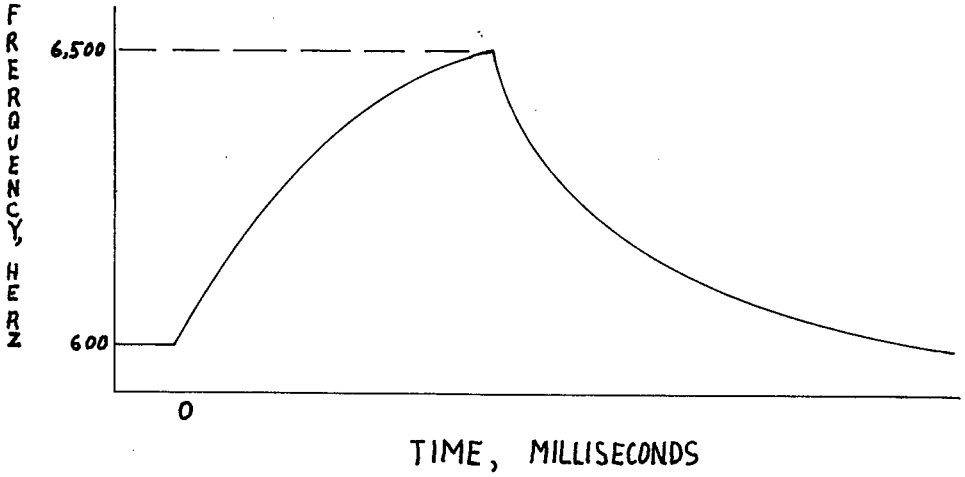
FIG. 3-C
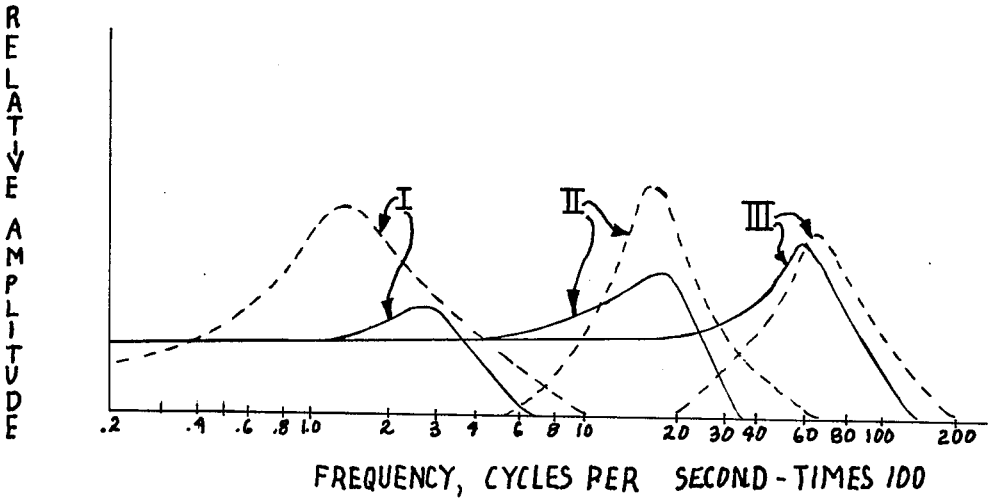

VARIABLE FILTER CIRCUIT, ESPECIALLY FOR SYNTHESIZING AND SHAPING TONE SIGNALS

The present invention relates to a variable filter arrangement, especially for synthesizing and shaping tone signals, and in particular, such a filter, or circuit, arrangement which can be made selectively effective and ineffective and selectively varied for producing desired effects.

The filter arrangement of the present invention finds a particularly apt use in electronic organs and is so described herein, but it will be evident that other uses can be made of the circuitry.

Electronic organs of the usual type provide a number of voices which can be selectively made effective and which provide for a relatively wide range of organ effects.

The present invention has as a primary objective the provision of special circuitry, involving a variable filter arrangement which will greatly expand the effects that can be obtained from an electronic organ and including the provision of means for obtaining unusual musical sounds and effects.

Another object is the provision of a special active filter arrangement for effecting the simultaneous shaping and amplitude modulation of tone signals while providing for variable frequency response shifts and the like.

It is also an object of the present invention to provide circuitry of the nature described which can be incorporated in a substantially conventional organ system and which can be made selectively effective and ineffective thereby permitting playing of the organ in a conventional manner.

It is a still further object to provide a novel circuit arrangement which is broadly useful in respect of synthesizing tone signals, shaping tone signals, keying tone signals and adapted for control from any of different devices, such as a knee lever, from the depression of a key, or from a rhythm unit.

BRIEF SUMMARY OF THE INVENTION

The invention includes a unique filter design that allows dynamic changes in the tone quality of signals processed. The circuit is intended primarily for use in electronic musical instruments, such as organs, and provides a very versatile voice control wherein standard voices and also unusual and musically interesting non-standard voices can be processed and/or created.

The system herein described is intended for insertion between the voice shaping circuits and the amplifying circuits, and can even be used in place of the voice shaping circuits.

The circuit consists of a three part filter, comprising first, second and third amplifiers, with interconnecting circuitry such that the output from the first amplifier resembles the output from a high pass filter, the output from the second amplifier resembles the output from a band pass filter and the output from the third amplifier resembles the output from a low pass filter. The particular frequency characteristics of each section are readily adjustable through either manual or automatic means.

The control circuit of the present invention consists of an envelope control circuit, which generates the transient attack and decay envelope upon key depression, an automatic-manual selector switch, and a control amplifier which receives the envelope signal, or a manual set signal, and any tremolo signal and controls the passage of current through an impedance which can, for example, embody a light emitting diode (LED).

The impedance referred to above is optically coupled to the adjustable components in the filter circuit and is operable to change the frequency characteristics of the parts of the filter thereby to obtain the effects desired.

The exact nature of the present invention will become more apparent upon reference to the following detailed specification taken in connection with the accompanying drawings in which:

FIG. 1 is a simplified block diagram showing one method by which the circuit of the present invention can be used in a standard organ circuit.

FIGS. 3A through 3C are frequency response curves developed in the circuitry of the present invention in several different modes of play.

FIGS. 4 and 4A are graphs showing signals in the circuit.

DETAILED DESCRIPTION OF THE INVENTION

Figure 2:
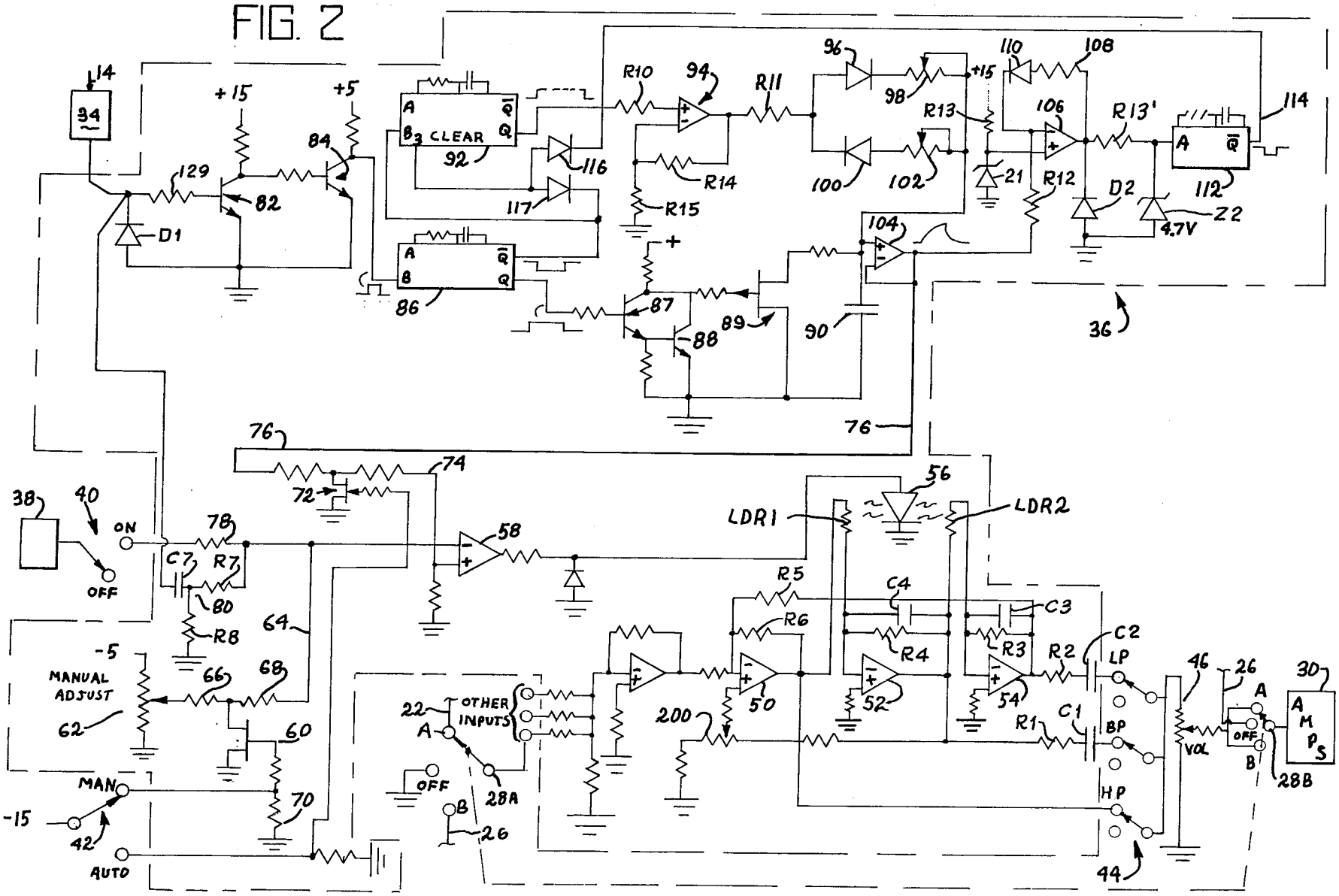
FIG. 2 is a somewhat more detailed schematic diagram of the circuit of the present invention.

Referring somewhat more in detail to the drawings, FIG. 1 shows a block diagram of the circuitry associated with one keyboard of a musical instrument, such as a standard organ, along with the circuit of the present invention.

A keyboard 10 is multiplexed by a multiplexer 12 producing a "data stream" on wire 14. The "data stream" wire 14 is connected to the input means 14' of a demultiplexer means 16, while the outputs of demultiplexer means 16 are connected to a bank of keyers 18. Each of keyers 18 is also connected to one output of a tone generator 20, and are operable to pass the signals from tone generator 20 to a wire 22 whenever an enabling signal is received from demultiplexer means 16.

Wire 22 is connected to the input of a voicing circuit 24 having an output wire 26. Wire 26 is connected to a double bladed, three position, selector switch having parts **28*a* and 28*b*. Selector switch part 28*a* selects the input signal for the filter modulator 36, which will be described in more detail hereinafter, while selector switch 28*b* selects the signal to form the input to amplifier circuit 30. Selector switch parts 28*a* and 28*b* are shown in FIG. 1 in the off position, in which the signal on wire 26 from voicing circuits 24 is connected directly to the input of amplifier 30. Amplifier 30 is, in turn, connected to supply speaker means 32**.

Wire 14 is also connected to the input of a key down detect circuit 34, which produces a single, narrow pulse whenever a new key is depressed on keyboard 10. The output of key detect circuit 34 is connected to one control input of filter modulator 36.

Also shown in FIG. 1 is a tremolo oscillator 38, which is connected to the blade of an ON/OFF selector switch 40 having one open terminal marked "OFF" and a second terminal connected to a second control input of filter modulator 36.

Filter modulator 36 is made up of a component identified in the trade as "Beckman Model 881 Universal Active Filter" with, in particular, the light sensitive resistors LDR1 and LDR2 connected in the circuit as shown.

Filter modulator 36 is provided with a switch 42 for selection of either manual operation, or automatic operation. With selector switch 42 in the manual position, the frequency characteristics of the filter modulator will be fixed, while with selector switch 42 in the automatic position, the frequency characteristics of filter modulator 36 will be varied automatically in response to each pulse from key detect circuit 34, to provide for a transient characteristic in the filter modulator.

The output of filter modulator 36 consists of a low pass output indicated at LP in FIG. 1, a band pass output, indicated at BP in FIG. 1, and a high pass output, indicated at HP in FIG. 1.

Each of the outputs of filter modulator 36 is provided with a respective selector switch, indicated at 44, so that any combination of the outputs of modulator 36 can be selected from any one to all thereof. Each of the selector switches indicated at 44 are connected to one terminal of a potentiometer 46, with the second terminal of potentiometer 46 connected to ground.

The audio output of the filter modulator 36 from one or more of outputs LP, BP, and HP, is taken off at the slider of the potentiometer 46. The slider of potentiometer 36 is connected to the remaining two terminals of selector switch part **28*b***.

Selector switch part **28*b* will pass the audio output of filter modulator 36 to the input of amplifier 30 whenever selector switch 28*b*** is in either the A position or the B position.

Operation of the filter modulator 36 can be better understood by referring to FIG. 2. The filter modulator will be seen to consist of an active filter made up of operational amplifiers 50, 52 and 54, along with the pertaining circuitry.

The amplifiers 50, 52 and 54 are interconnected to form a filter. The output of amplifier 50 is connected to the high pass output HP of filter modulator 36. The output of amplifier 52 is connected through a resistor R1 and capacitor C1 to the band pass output BP while the output of amplifier 54 is connected through a resistor R2 and capacitor C2 to the low pass output LP of filter modulator 36.

The frequency characteristic of the filter is controlled by the light dependent resistors LDR1 and LDR2. LDR1, connected between the output of amplifier 50 and the input of amplifier 52, controls the center frequency of that part of the filter formed by amplifier 52, and LDR2, connected between the output of amplifier 52 and the input of amplifier 54, controls the break, or roll-off, frequency of that part of the filter formed by amplifier 54. As LDR1 and LDR2 control the frequency characteristics of amplifiers 52 and 54, respectively, the frequency characteristic of amplifier 50 is also controlled. Resistor R3 and capacitor C3 in parallel provide for feedback from the output to an input of filter 54, while resistor R4 and capacitor C4 perform the same function for amplifier 52. Further, resistor R5 provides a feedback path from the output of amplifier 54 to an input of amplifier 50. A resistor R6 provides feedback from the output of amplifier 50 to an input thereof while the other input of amplifier 50 is grounded via variable resistor 200.

The blade of selector switch part **28*a* is shown in FIG. 2 as connected to one input of filter modulator 36. Two additional inputs, indicated in FIG. 2** as "other inputs" are provided. Any signal in the audio frequency range can be connected to these other inputs, not necessarily the standard organ voices, resulting in unusual and unique tones.

LDR1 and LDR2 are optically coupled to, and controlled by, a light emitting diode 56. The intensity of the light emitted by LED 56 is controlled by the amount of current passing therethrough, which is controlled by operational amplifier 58. The inputs to amplifier 58 are selected by the manual/automatic selector switch 42. When selector switch 42 is set in the manual position, a negative voltage will be applied to the gate input of FET 60, holding it to a nonconductive state. With FET 60 in the nonconductive state, there will be a very high impedance between the junction of resistors 66 and 68 and ground via the source drain path of FET 60. This will result in the voltage selected by the slider of potentiometer 62 to be applied to wire 64, which is connected to the inverting input of amplifier 58.

On the other hand, with selector switch 42 in the automatic position, the gate terminal of FET 60 will be held at ground potential through resistor 70, thus holding FET 60 in the conductive state, and providing a low resistance path from the junction of resistors 66 and 68 to ground. This will cause essentially zero volts to be applied to wire 64 and, therefore, to the inverting input of amplifier 58.

Similarly, the terminal of selector switch 42 labeled automatic is connected to the gating input of an FET 72, which operates the same as FET 60. With the selector switch 42 in the manual position, FET 72 will be in the conductive state and therefore will apply essentially zero volts to wire 74, which is connected to the noninverting input of amplifier 58. With selector switch 42 in the automatic position, FET 72 will be held in the nonconductive state, and any signal present on wire 76 will be passed to wire 74.

Also connected to the inverting input of amplifier 58 is a signal from the tremolo oscillator 38, through selector switch 40 and resistor 78, and a signal from the key detect circuit 34 through the serially connected resistor R7 and capacitor C7 of filter circuit 80. Circuit 80 has the juncture of R7 and C7 grounded via resistor R8.

With selector switch 42 in the manual position, the voltage selected by the slider of potentiometer 62 will be applied to the inverting input of amplifier 58, causing a fixed voltage to be developed at the output of amplifier 58. This fixed voltage at the output of amplifier 58 will cause a constant current to flow through light emitting diode 56, thus causing the resistances of LDR1 and LDR2 to remain fixed at a corresponding value and in a fixed frequency characteristic for the amplifiers in the filter modulator 36. With the selector switch 42 in the automatic position, the voltage selected by potentiometer 62 will be shunted to ground, and the voltage present on wire 76 will be allowed to pass to wire 74 and, therefore, to amplifier 58.

The voltage, or signal, present on wire 76 will then be of a varying type, and will cause the current through light emitting diode 56 to vary with time, varying the values of LDR1 and LDR2 and creating a frequency characteristic for the filter modulator 36 which also varies with time.

The signal developed on wire 76 is produced in response to the pulses developed by the known circuit 34 which develops a pulse each time a key of the keyboard is depressed.

Transistors 82 and 84 provide an interface with the output of key detect circuit 34 and the input of a monostable multivibrator 86. The interface is necessary to convert the pulse output from key detect circuit 34 to the five volt logic level input necessary for monostable 86.

Key detect circuit 34 will produce a positive pulse at its output for each key down signal occurring on the multiplex data stream on wire 14, which will momentarily cause transistor 82 to switch to the conductive state. As transistor 82 switches to the conductive state, the base terminal of transistor 84 will be pulled to a low voltage, causing transistor 84 to switch to the nonconductive state for a brief time, thereby delivering a positive pulse to the B input of monostable multivibrator 86. Diode D1 connecting the emitter of transistor 84 to the base resistor R9 of transistor 82 provides for cut off of transistor 82.

When the positive pulse is delivered to the B input of monostable 86, the Q and Q outputs will each produce a pulse, as indicated diagrammatically in FIG. 2.

The positive pulse produced at the Q output of monostable 86 will switch transistors 86, 88 and 89 into conduction, thus discharging any voltage impressed upon capacitor 90.

The Q output is connected to the B input of monostable 92. Monostable 92 will produce a pulse at its Q output whenever a low to high transition occurs at its B input. This low to high transition will occur at the end of the output pulse produced by monostable 86. This provides a short time period for the initial discharging of capacitor 90, immediately following a key down signal from key detect circuit 34. The positive signal at the output of monostable 92 is connected via resistor R10 to the non-inverting input of an operational amplifier 94, which forms a substantially constant current source by virtue of R11.

It will be noted that the Q output of monostable 86 is connected via a diode 117 with the clear terminal of monostable 92 so that a negative transition at the Q output of monostable 86 will clear monostable 92.

The output of operational amplifier 94 is connected via resistor R11 through a diode 96 and a variable resistor 98 to and also to the noninverting input of an amplifier 104. Current from resistor R11 also passes through a diode 100 and a variable resistor 102 to capacitor 90. The polarity of diodes 96 and 100 are reversed, so that when the output of amplifier 94 is more positive than the voltage on capacitor 90, diode 96 will be conductive and capacitor 90 will be charged to a positive voltage through variable resistor 98.

With the output of amplifier 94 more negative than the voltage on capacitor 90, diode 96 will become reversed biased and diode 100 will be forward biased and thus allowing capacitor 90 to discharge through variable resistor 102.

Variable resistor 98 thus allows for a controlled rate of charge of the voltage on capacitor 90, while resistor 102 allows for a controlled rate of discharge of the voltage on capacitor 90. Capacitor 90 is also connected to the positive input of operational amplifier 104, which is connected as a voltage follower. The output of amplifier 104 is connected to wire 76. A typical wave form occurring at the output of amplifier 104 immediately after the reception of a key detect pulse from circuit 34 is shown in FIG. 2.

The output of amplifier 104 is also connected through a resistor R12 to the inverting input of an operational amplifier 106. The non-inverting input of amplifier 106 is held at 7 ½ volts by a resistor R13 and Zener diode Z1 combination, as shown in FIG. 2. The feed back circuit for operational amplifier 106 consists of a resistor 108 and a diode 110. Whenever the output of amplifier 104 is less than 7.5 volts, the output of amplifier 106 will be positive, thus forward biasing diode 110, and allowing resistor 108 to form a negative feed back for amplifier 106.

As the voltage at the output of amplifier 104 becomes greater than 7.5 volts. The output of amplifier 106 will swing to a negative voltage, thus reverse biasing diode 110, and preventing any negative feed back through resistor 108. This will cause the output of amplifier 106 to swing sharply to approximately 0.5 volts below ground potential, thus providing a sharp negative transition via resistor R13 at the A input of the monostable multivibrator 112.

Monostable 112 will produce a negative pulse at its Q output in response to any sharp negative transition at its A input. The Q output of monostable 112 is connected through wire 114 and diode 116 to the clearing input to monostable multivibrator 92. A diode D2 is connected between ground and the output of amplifier 106 while a Zener diode Z2 is connected between ground and the A input of monostable 112.

The output of amplifier 94 is connected via resistor R14 to the inverting input thereof which, in turn, is connected to ground via resistor R15.

When a clearing pulse is provided at the input of multivibrator 92, its Q output will switch from a positive output to a zero output, at which time the output of amplifier 94 will also switch from a positive voltage to a low voltage, thus reverse biasing diode 96 and forward biasing diode 100. Capacitor 90 will then discharge through resistor 102 until the voltage on capacitor 90 is equal to the voltage at the output of amplifier 94.

The circuit will remain in this state until another key detect pulse is received from key detect circuit 34.

As the voltage at the output of amplifier 104 swings through its cycle, the current through light emitting diode 56 will increase and decrease in a proportional manner, thus causing the frequency characteristics of the filter formed by amplifiers 50, 52 and 54 to vary.

The variation in frequency characteristics of the filter with varying currents through light emitting diode 56 in respect of resonance control is illustrated more clearly in FIGS. 3A, 3B and 3C. FIG. 3A illustrates the resonance control characteristic for each section of the filter, that is, the band pass, the low pass and the high pass sections, or portions, of the filter, for three different levels of current passing through light emitting diode 56. The full lines correspond to the low pass filter output LP, the dashed lines correspond to the band pass filter output BP, while the dot-dash lines correspond to the high pass filter output HP. The sets of lines indicated at I, II, and III show the filter characteristics at three different degrees of energization of light sensitive resistors LDR1 and LDR2. In FIG. 3A, it will be noted that the full line curves and the dotted line curves and the dot-dash line curves are offset laterally from each other thus sharing the low pass, band pass, and high pass characteristics relating to each set.

It will be noted that for low current level through light emitting diode 56, the center frequency at the band pass terminal filter of the filter is at, for instance, about 600 cycles per second, while, as the current through light emitting diode 56 increases, the center frequency at the band pass terminal of the filter sweeps up to, for instance, 6,500 cycles per second.

Similarly, the break frequencies at the low pass terminal of the filter and at the high pass terminal of the filter also sweep from lower values to high values as the current through light emitting diodes 56 is increased.

With the current through LED 56 varying, it will be apparent that the characteristic of filter modulator 36 will also vary.

More specifically, the change in the characteristic of filter modulator 36 is shown by the three sets of curves in FIG. 3A and marked with roman numerals I, II, and III, with roman numeral I indicating the set of curves for the three filter outputs corresponding to the lowest value of current through LED 56, and roman numeral III indicating the set of curves corresponding to the highest value of current through LED 56.

The curves in FIGS. 3A and 3C corresponding to the low pass output are drawn with a solid line, while the curves corresponding to the band pass output are drawn with a dotted line, and the curves corresponding to the high pass output are drawn with a dot-dash line.

FIG. 3C shows response frequency curves at different degrees of illumination of LDR1 and LDR2.

With selector switch 42 in the automatic position, the filter characteristics would vary, for instance, from the response characteristic of the curves marked I to the response indicated by the curves marked III, and then back to the curves marked I.

The variation in response characteristics will be in a smooth manner, as can be seen in FIG. 3B.

FIG. 3B shows the time versus frequency characteristic of the center frequency of the band pass output of the filter immediately following the depression of a key on keyboard 10. The break points of the high and low pass outputs vary in proportion to the curve shown in FIG. 3B.

A further adjustment is provided, shown in FIG. 2, in the form of potentiometer 200. Potentiometer 200 forms a resonance control, and controls the band width at the band pass output of the filter.

FIG. 3C shows typical response curves for the band pass and low pass outputs of the filter for three different settings of potentiometer 200. As in FIG. 3A, the three sets of curves correspond to three different levels of current through LED 56, with the curves marked with I, II or III corresponding to the lowest to the highest currents respectively. However, in FIG. 3C, the curves each correspond to three different settings of potentiometer 200.

Further response characteristic curves are shown in FIGS. 4 and 4A, in which the amplitude of the output of the filter modulator is shown as a function of time for two different modes of play.

More specifically, FIG. 4 shows the amplitude versus time curve of the output of the filter modulator following the depression of a key.

FIG. 4A shows the amplitude versus time curve of the output of the filter modulator following the depression of a key when the selector switch 40 is switched to the ON position, thus selecting the tremolo effect.

It will be noted from FIGS. 4 and 4A that the band pass and low pass outputs of the filter modulator, when selected, can operate to perform a keying function, because there is no signal flow through at these outputs when the current through LED 56 is reduced fully to zero.

It should be noted also that the input to the filter modulator on wire 22 from the keyers 18 can consist of several different tone signals simultaneously, such as the notes of a cord.

A selector switch 210 is provided for further expanding the versatility of the filter modulator. Selector switch 210 is adapted to connect pulses from the organ rhythm unit 212 to the trigger input of the envelope control circuit. With selector switch 210 closed, the envelope control and filter modulator circuit will respond to each pulse from the rhythm unit in the same manner as to pulses from the key down detect circuit 34.

With switch 210 closed, and the band pass and low pass outputs of the filter selected, the filter modulator circuit can be used to key percussion notes, or chords, in a rhythmic pattern.

The variable impedance means illustrated in circuit with the band pass and low pass outputs of the filter are illustrated as light sensitive resistor elements, but it will be understood that the particular means of varying the resistance or impedance represented by the light sensitive resistors is not the only manner in which this function could be performed. For example, MOS transistors could have the source to drain connections interposed in place of the light sensitive resistors with the gate terminals connected to be supplied with a varying voltage from amplifier 58. Such transistors, especially with a feedback resistor, will serve as a suitable element for varying the filter modulator characteristics.

Still further, the light sensitive resistors which are under the influence of light emitting diode 56 could be replaced by voltage controlled amplifiers, and these amplifiers could be supplied with a varying voltage from output side of amplifier 58. In any case, it will be appreciated that a variable impedance is inserted in the filter modulator circuit which is under the control of any of several selectable influences and which can be varied in different manners.

From the foregoing, it will be seen that the present invention provides means for obtaining a substantially unlimited number of special and unusual sounds and effects in respect of production of music. Some of the features which can be obtained include automatic brass mute, percussion, brass and woodwind sounds, sustain and the synthesizing of voices, all of which will enhance the existing organ voices while the synthesizer can serve as a voice.

The practice of the invention permits the effect of presenting a solo instrument with organ voices and with varying harmonic characteristics. The circuitry includes a unique filter modulator having a multipurpose function and includes a highly flexible envelope control system.

The circuitry of the present invention can be utilized as a filter which can be varied over a wide range of frequency characteristics to provide for various tonal effects. A further function is that it allows modulation of the filter to produce a tremolo effect while still another function provides for shutting off portions of the filter to stop the passage of signals therethrough so that the filter can operate as a keyer and also achieve percussion effects.

The circuitry can handle monophonic and polyphonic signals and can operate under the control of playing keys so that the filter modulator will be triggered to go through a cycle each time a key is depressed. The filter modulator can also be triggered or activated from other sources, such as pulses from a rhythm unit, from an expression pedal, or a knee lever.

The filter modulator can be employed in respect of existing voices or any other source of audio signals and can, likewise, serve, itself, to shape tone signals which may be in the form, for example, of square waves or saw tooth waves or the like.

Modifications may be made within the scope of the appended claims.

What is claimed is:

1. The method of producing special sound effects in an electronic organ having a tone generator, an output circuit including an acoustic transducer, and playing keys with each key when depressed controlling the supply of a respective tone signal from the generator to the output circuit, said method comprising:

interposing a filter circuit comprising a first amplifier, a second amplifier and a third amplifier connected in series in the order named and connected between the tone generator and output circuit, interposing a variable impedance element in the inputs to each of the second and third amplifiers, said filter circuit having a high pass filter characteristic output, a band pass filter characteristic output and a low pass filter characteristic output corresponding to respective ones of the first, second and third amplifiers, detecting the depression of a key and generating a transient control signal, controlling the rise and the decay of the transient control signal, and varying the values of the variable impedance elements in accordance with the transient control signal to vary the characteristics of the filter circuit.

2. The method of claim 1 wherein the high pass output, band pass output and low pass output are selectively connected to the output circuit.

3. The method according to claim 1 in which said elements are light sensitive and the varying of said elements includes varying the illumination of said elements manually.

4. The method according to claim 1 which includes providing a light source for illuminating both of said elements simultaneously, initiating a supply of energy for said light source substantially simultaneously with the depression of a playing key, and controlling the rates of rise and decay of the supply of energy to said light source.

5. The method according to claim 1 which includes establishing negative feed back from the output sides of said second and third amplifiers to the input side of said first amplifier.

6. An electronic organ having a tone generator and a transducer and a keyboard having playing keys with each key when depressed controlling the supply of a respective tone signal from said generator to said transducer means, a circuit interposed between said tone generator and said transducer and operable for modifying the wave form of signals passing from the generator to the transducer means, said circuit having a signal input terminal and at least first and second signal output terminals, a variable impedance means operatively connected in circuit with each of said first and second signal output terminals to modify the wave form of the signals supplied to said first and second terminals, first means operable in response to the depression of a said key for generating a transient first voltage signal, second means manually operable for developing an adjustable second voltage signal, voltage sensitive means operable when actuated to cause variations of said impedance means, and selector means operable for connecting said voltage sensitive means for being actuated in response to a selected one of said first and second voltage signals.

7. An electronic organ according to claim 6 in which said voltage sensitive means is operable for varying said impedance means simultaneously.

8. An electronic organ according to claim 6 in which each said variable impedance means comprises light sensitive impedance means and said voltage sensitive means comprises a light source positioned to illuminate said light sensitive impedance means.

9. An electronic organ according to claim 6 in which said circuit includes first, second and third signal output terminals and first, second and third amplifiers connected in series and each having an output side connected to a respective one of said output terminals, each said variable impedance means being disposed between the output side of one amplifier and the input side of the next following filter.

10. An electronic organ according to claim 9 in which each said variable impedance means comprises light sensitive impedance means and said voltage sensitive means comprises a light source positioned to illuminate said light sensitive impedance means.

11. An electronic organ according to claim 9 in which said amplifiers are connected in series between said input and output terminal means in the order named, and one impedance means is connected between the output side of the first amplifier and the input side of the second amplifier and the other impedance means is connected between the output side of the second amplifier and the input side of the third amplifier.

12. An electronic organ according to claim 11 which includes switch means for selectively connecting the output side of any of the amplifiers directly to a respective signal output terminal means.

13. An electronic organ according to claim 11 in which each said variable impedance means comprises light sensitive impedance means and said voltage sensitive means comprises a light source positioned to illuminate said light sensitive impedance means.

14. An electronic organ according to claim 13 which includes switch means for selectively connecting the output side of any of the amplifiers directly to said output terminal means.

15. An electronic organ according to claim 6 in which said means for generating a transient first voltage signal includes means for controlling the rise and decay of said first voltage signal.

16. An electronic organ according to claim 9 which includes means connecting the output sides of said second amplifier and of said third amplifier to the input side of said first amplifier as negative feed back.

17. An electronic organ according to claim 6 in which said selector means comprises a pair of FET transistors each having one of its source and drain connected respectively to said first and second means and the other of its source and drain being connected to ground, a source of voltage for connection to gate terminals of said transistors to cause the transistors to go to nonconduction, and a selector switch for selectively connecting said transistor gate terminals individually to said source.

18. An electronic organ according to claim 6 which includes signal source means for connection to the input side of said first amplifier.

19. An electronic organ according to claim 6 which includes means for making said signal output terminals ineffective for passing signals to said transducer means, and means operable in response to the depression of a key for making said signal output terminals effective for passing signals to said transducer means whereby said circuit forms a keyer.

20. An electronic organ according to claim 6 in which said voltage sensitive means includes a source of tremolo voltage operatively connected thereto.

* * * * *

UNITED STATES PATENT AND TRADEMARK OFFICE

CERTIFICATE OF CORRECTION

PATENT NO. : 4,106,384

DATED : August 15, 1978

INVENTOR(S) : BILLY J. WHITTINGTON, JOHN WILLIAM ROBINSON and RALPH N. DIETRICH

It is certified that error appears in the above-identified patent and that said Letters Patent are hereby corrected as shown below:

Column 4, line 46, after "and" insert --result--.
Column 5, line 14, "Q" second occurrence should be --$\bar{Q}$--.
Column 5, line 16, "86" second occurrence should be --87--.
Column 5, line 20, "Q" should be --$\bar{Q}$--.
Column 5, line 32, "Q" should be --$\bar{Q}$--.
Column 5, line 34, "Q" should be --$\bar{Q}$--.
Column 5, line 38, "capacitor 90" omitted after "to" first occurrence.
Column 6, lines 13 and 15, "Q" should be --$\bar{Q}$--.
Column 7, line 32, "of the filter" omitted after "outputs".

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*